United States Patent [19]

Gehring et al.

[11] Patent Number: 4,665,712

[45] Date of Patent: May 19, 1987

[54] HEAT PUMP WATER HEATER SYSTEM

[75] Inventors: Kenneth C. Gehring, Cottage Grove; Ralph K. Rustebakke, Madison, both of Wis.

[73] Assignee: DEC International, Inc., Madison, Wis.

[21] Appl. No.: 807,322

[22] Filed: Dec. 10, 1985

[51] Int. Cl.[4] ..... F25B 29/00

[52] U.S. Cl. ..... 62/325; 62/93; 62/173; 62/238.7; 62/526; 165/140

[58] Field of Search ..... 62/238.6, 238.7, 515, 62/519, 524, 526, 90, 93, 173, 428, 325; 165/140

[56] References Cited

U.S. PATENT DOCUMENTS

| | | | |
|---|---|---|---|
| 2,672,020 | 3/1954 | Wurtz et al. | 62/526 |
| 2,691,872 | 10/1954 | Schaeffer | 62/442 |
| 2,803,439 | 8/1957 | Kikenscher | 165/140 |
| 2,913,228 | 11/1959 | Kikenscher | 165/140 |
| 2,961,844 | 11/1960 | McGrath | 62/181 |
| 3,520,147 | 7/1970 | Glackman | 62/173 |
| 3,738,117 | 6/1973 | Engel | 62/173 |
| 4,123,914 | 11/1978 | Perez et al. | 62/238.6 X |
| 4,193,443 | 3/1980 | Nanaumi et al. | 62/93 X |
| 4,321,797 | 3/1982 | Yaeges et al. | 62/238.6 X |
| 4,428,205 | 1/1984 | Dodeses | 62/93 |
| 4,474,018 | 10/1984 | Teagan | 62/238.6 X |
| 4,535,603 | 8/1985 | Willitts et al. | 62/238.6 X |

FOREIGN PATENT DOCUMENTS

| | | | |
|---|---|---|---|
| 2143014 | 1/1985 | United Kingdom | 62/526 |

*Primary Examiner*—Albert J. Makay
*Assistant Examiner*—Steven E. Warner
*Attorney, Agent, or Firm*—Bayard H. Michael

[57] ABSTRACT

A condenser receives hot compressed refrigerant from the heat pump compressor and transfers heat to water in water heater, refrigerant flows from the condenser through a pressure reducer to an evaporator coil in which baffles define first and second air flow paths across the coil parallel to the coil gradient. In one path the temperature of air flowing across the coil is reduced while the air gives up heat to the refrigerant. The other air flow path heats air passing across the coil. A multiplicity of pressure reducers are provided in the coil to progressively drop the temperature of the refrigerant from one end of the coil to the other. A supplemental coil can be used in conjunction with the second air flow path to heat air further. The supplemental coil may receive hot refrigerant directly from the condenser.

6 Claims, 9 Drawing Figures

HEAT PUMP WATER HEATER SYSTEM

BACKGROUND OF THE INVENTION

The present invention relates to heat pump water heaters which are not new per se. The invention also relates to ventilation of modern heavily insulated and sealed buildings. Such residences require forced ventilation in all seasons of the year. In winter it is desirable to exhaust air from the house and replace it with fresh, heated air. In summer it is desirable to exhaust the air from the house and replace it with cooled, fresh, dehumidified air. It is desirable to dehumidify the basement in summer. In spring and fall the stale air should be exhausted from the house and replaced with fresh outside air which is warmed up to a comfortable level. All of the desireable ventilation characteristics have been recognized but, if accommodated in a home, have entailed additional equipment and operating costs.

This invention is directed to operation of a heat pump water heater with a special ducting arrangement enabling all of the above characteristics to be achieved with the normal operation of the heat pump water heater. Initial testing indicates that the water heating cost with this system is competitive with natural gas (and about 50% of the cost of electric resistance heating) while giving the benefit of "free" dehumidification and ventilation. Furthermore, during the summer the system reduces the air conditioning requirements.

SUMMARY OF THE INVENTION

This invention provides a heat pump system having a compressor delivering hot compressed refrigerant to a condenser coil which transfers heat to the water heater and is connected to an evaporator coil in which the temperature and pressure of the refrigerant is reduced. Two separate air flow paths across the evaporator coil are provided. A feature of the invention is that the temperature of air passing over one path is increased and the temperature of the air passing over the other path is decreased.

Another feature of the invention is that the coil has a planar, generally rectangular configuration and the air paths are parallel to the length of the rectangle.

Another feature of the invention is that the coil is provided with a multiplicity of expansion control devices which progressively decrease the temperature of the refrigerant in the coil.

Still another feature of the invention is the provision of auxiliary tubing in one of the air flow paths and receiving hot partially condensed refrigerant from the condenser to provide additional heating in said path. Another feature used in conjunction with the auxiliary tubing is that there is a further expansion control device between the auxiliary tubing and the main part of the evaporator coil to reduce the temperature of the refrigerant leaving the auxiliary tubing to the normal entry temperature of refrigerant entering the coil from the condenser.

An important feature of this invention is the operation of the heat pump system described above to cool and dehumidify outside air passing through the first of the air flow paths and to heat and dehumidify air taken from the basement of the structure to heat and dehumidify ambient air and discharge heated, dehumidified air back into ambient space. This operation is particularly advantageous in summer when outside air is cooled and injected into space to be cooled while at the same time ambient air around the heater in the basement is dehumidified.

All of these features are obtained in conjunction with the primary function of heating hot water.

DETAILED DESCRIPTION OF THE DRAWINGS

Figure 1:
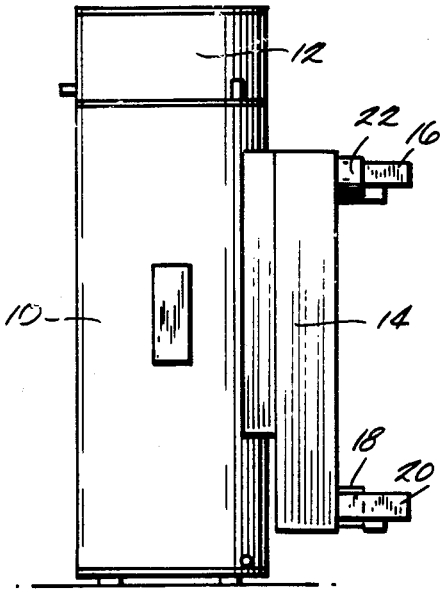
FIG. 1 is a side elevation of a heat pump water heater incorporating the present invention.

Heat pump water heaters are well-known and typically have, as shown in FIG. 1, a water tank 10 with a refrigeration unit housed in the enclosure 12 on top of the tank. The refrigeration unit includes a typical refrigerant compressor 80 which delivers the hot compressed gas to a condenser 82 located in the housing 10. The condenser 82 has a heat exchange relationship with water in the tank and therefore the heat in the condenser is transferred to the water in the tank to heat the water.

Figure 2:
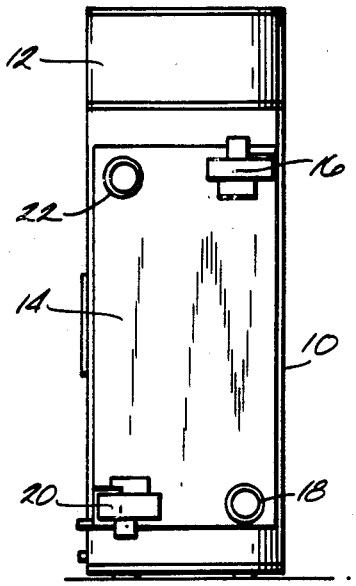
FIG. 2 is a front elevation of the water heater and shows the two air inlets and two air outlets incorporated in the heat exchanger.

In the present invention, the evaporator coil 84 is of unusual design and has unusual construction. The evaporator 84 is located in housing 14 secured to the side of the tank. As can be seen in FIG. 2, the evaporator housing 14 has an air inlet and fan at 16 in the upper right-hand corner of the housing. This inlet leads to a first airflow path downwardly along the right side of the inside of the housing 14 to exit at 18. The heat exchanger 84 is also provided with a second air inlet and fan at 20 at the lower left of the housing (FIG. 2) with an outlet 22 at the upper left. This is a second airflow path across the evaporator coil tubing.

Figures 6, 7, 8:
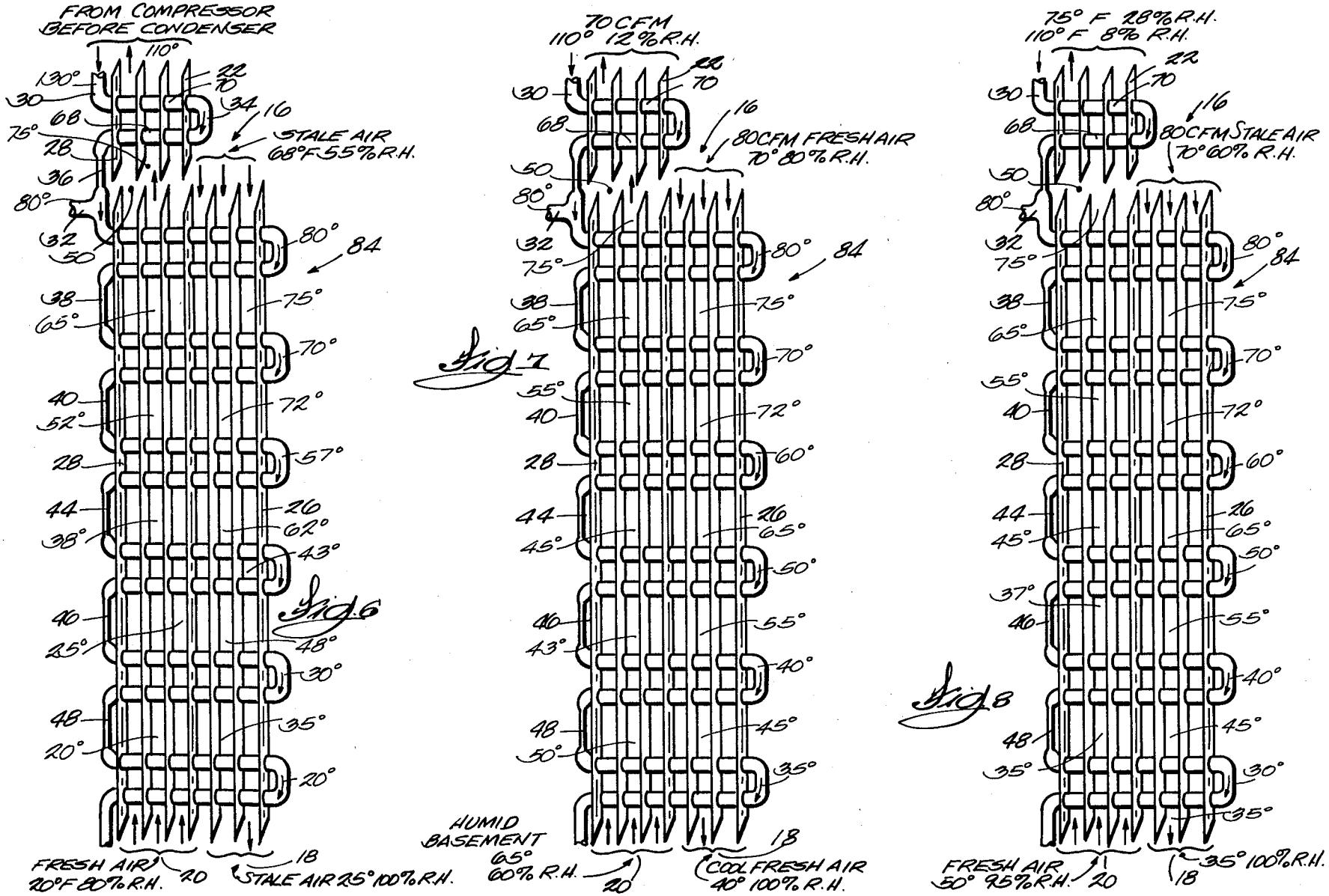
FIG. 6 is a semi-schematic representation of the heat exchanger showing the two longitudinal airflow paths through the heat exchanger and also shows typical temperatures when the system is operated the winter mode. The central and two side panels are specially shaded to make the airflow paths stand out.
FIG. 7 is similar to FIG. 6 but shows the temperature conditions and air flow in the evaporator coil during summer operation in the dehumidification mode.
FIG. 8 shows the temperature considerations in the evaporator when hooked up for spring or fall operation.
Figure 9:
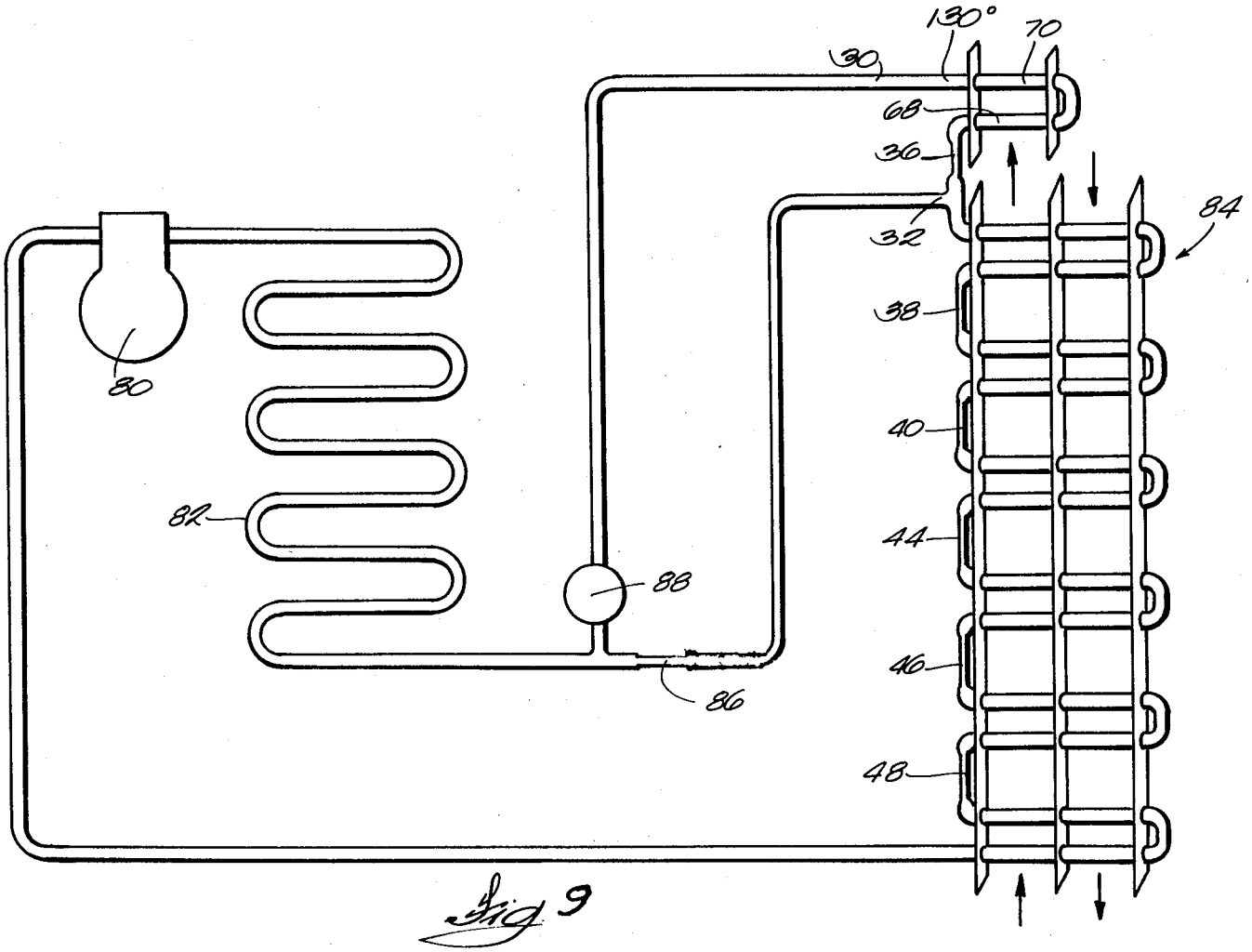
FIG. 9 is a schematic drawing of the heat pump system.

FIGS. 6 and 9 are schematic representations of the manner in which this heat exchanger or evaporator coil 84 is laid out. The first thing to be noted is that there is a central divider 24 vertically separating the housing 14 into two vertical ducts or airflow paths. The first airflow path has an air inlet 16 and outlet 18 and is confined to the space between divider 24 and the right side plate 26. The second airflow path has an inlet 20 (lower left) and an outlet 22 (upper left) and confines the air to flow between the central divider 24 and the left side plate 28.

The outlet of condenser 82 is connected to the primary inlet 32 through a capillary tube (pressure reducer) 86. The capillary tube can be by-passed by opening valve 88 to pass hot partially condensed refrigerant gas at about 130° to auxiliary inlet 30. If the by-pass is open condensed refrigerant will continue to flow to inlet 32 at about 80°. If hot gas at 130° is being introduced at auxiliary inlet 30, it will make a short pass 70 to the reverse bend 34 and return to the left in tube 68 through the side plate 28 where it enters a flow restrictor or pressure reducer 36 to drop the temperature of the gas from 130° (the temperature at which it entered auxiliary inlet 30) to 80° which is the temperature of gas entering main inlet 32 from the condenser. The 130° gas is an optional feature which will be explained more fully hereinafter. The gas is substantially hotter and has more energy to transfer the air than does the gas entering inlet 32. If the same hot gas was condensed, the temperature would drop as the gas gives up heat to the hot water in the tank and would leave the condenser at about 80° to enter inlet 32.

Considering the evaporator coil 84 further, the tubing is laid out in a serpentine manner with successive passes through the adjacent ducts or flow paths. Thus, going from main inlet 32, the refrigerant first goes through the second duct or flow path past the central divider 24 and then into the first airflow path, out the side wall 26 where the reverse bend returns the tubing for a second pass through the first path and then a second pass through the second path. At this point, the refrigerant gas goes through a capillary restrictor or pressure reducer 38 and takes another couple passes, goes through another restrictor 40 followed by two more passes and then restrictor 44, two more passes, restrictor 46, two more passes and restrictor 48 which is followed by two more passes and then the gas returns to the compressor.

In the winter operation mode, stale air from the space to be heated is introduced to inlet 16 of the first duct or flow path and the heat is recovered from the stale air and then the air is dumped to the outside after the temperature has been taken from 68° to 25° in a typical situation. Fresh air is introduced at 20 to the second duct or airflow path and is heated going over the same coils, in effect, but over a different flow path. Thus, the fresh air entered at the cool end of the coils and is warmed up as it progresses up through the second duct until at space 50, between inlet 32 and the exit from the first two short passes, the temperature might typically be 65° assuming fresh air coming in at 20°. This air can be put into the space 54. If that temperature (65°) is deemed to be too low for comfort or more ventilation is required beyond the need for domestic hot water, the system can be operated in the alternate mode where some uncondensed hot gas from the condenser outlet is introduced at auxiliary coil inlet 30 at 130° to raise the temperature of the air at outlet 22 to somewhere between 90° and 110°. Then that warm air would be introduced to space 54.

Figure 3:
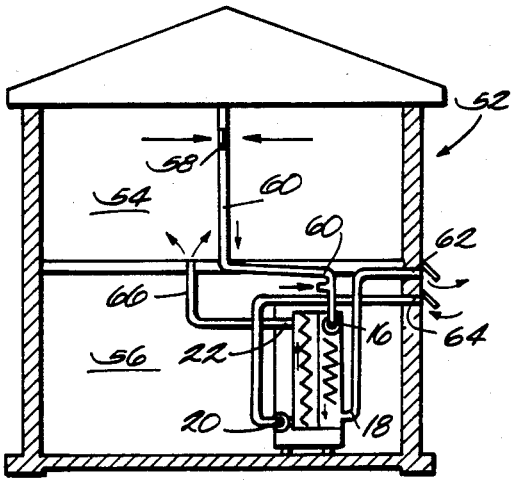
FIG. 3 is a schematic drawing of the manner in which this water heater will be hooked up for operation in the winter months.

FIG. 3 is a simplified hook-up for this arrangement. In this design the building 52 has a first floor space 54 to be heated or air conditioned, depending upon the season for the year. It also has a basement 56 in which the hot water heater is located. Stale air is drawn from the first floor level 54 through the outlet 58 and duct 60 to enter inlet 16 on the heat exchanger. Outlet 58 can have fan assistance. Some air can be drawn from the basement space 56 and enter the conduit 60 if desired. The stale air makes a downward pass and exits at 18 to be exhausted from the building at 62. In the process of the pass over the evaporator coil, the air typically is dropped from 68° F. and 55% RH to 25°F. and 100% RH. Thus, a considerable amount of heat is removed from the air before dumping it. At the same time, air is being taken in from outside through inlet 64 and enters at 20 to make a pass over the coils and exit at 22 to enter the space 54, typically at 65° assuming an outside temperature of 20°. If desired, as indicated above, the optional mode of operation can be employed where the air is heated even further by passing it over the two short coil runs 68, 70 to enter the heated space at 110°. This makes the entering air more comfortable when mixed with the room air, and extends the operating time of the system.

The present evaporator coil has an elongated rectangular configuration and, instead of the air going across the coil normal to the plane of the coils as typical in the usual evaporator coil or heat exchanger, the air passes along the length of the coil parallel to the temperature gradient. Another difference from convention is that there are two air flow paths across the same coil. Thus, "double mileage" is being obtained from the coil. The coil is used to recover heat from air which is being exhausted from the building while fresh air is being put into the building from outside. This arrangement assures a supply of fresh air to a contemporary building which is typically very air-tight with resulting difficulty in maintaining fresh air levels. Finally, a feature of this coil which should be noted is that the temperature of the coil is progressively reduced. Thus, the restrictors (which, in effect, are fixed valves) 38, 40, 44, 46, 48, progressively drop the coil temperature. These temperatures are marked on the drawing for illustrative purposes and the air temperatures as it passes over the coil in the two paths are also marked.

Figure 4:
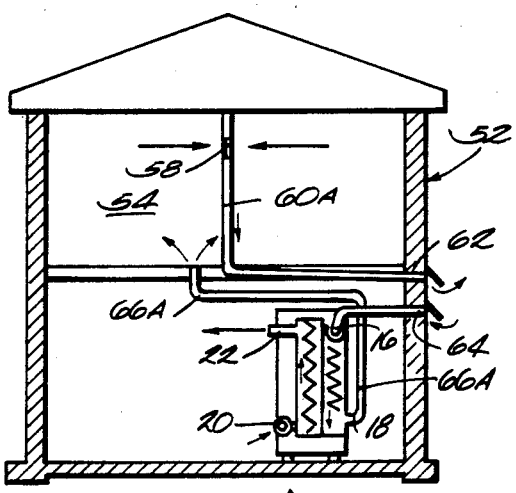
FIG. 4 is a schematic showing the connection for the water heater in the summer months with the unit operating in the dehumidification mode.

Now considering the operation of this system in the summer, the stale air from the space 54 is exhausted through duct 60A (by the fans) to be directly exhausted from the building at 62. The fresh air enters at 64 and is ducted to inlet 16 to pass over the coil to exit at 18 and then flow through duct 66A to the cooled space 54. Considering this in conjunction with FIG. 7, it will be seen that this will entail, in a typical summer situation, bringing in fresh outside air at 70° and delivering 40° air to the space 54. As can be seen in FIG. 4, humid basement air is drawn into the inlet 20 to pass upwardly through the second air path to be exhausted at 22. The typical basement air may be assumed to be 65° and have 60% relative humidity. As it rises through the second air path it starts by going over tubes at 35°, then 40°, 50° and 60°. All of these will condense water from the air. Thus, the air is being dehumidfied as it rises. It will finally be delivered to the basement space at 75° but at 35% humidity (at space 50 in the coil). If desired, the optional mode can be utilized to heat the auxiliary coil 68/70 so that the air comes out at 110° and 12% relative humidity. This later mode, in effect, costs money whereas the mode without the supplemental heat in the two auxiliary coils 68 and 70 is what might be called "free" dehumidification. The feature of interest in this summer mode operation is that fresh air is cooled over the coil and is delivered to the house while the basement air is dehumidified. The water heating with this arrangement is competitive with natural gas and costs about ½ that of electric resistance heating. On top of that, the user gets, in effect, "free" dehumidification and ventilation. With this summer mode operation as just described, the stale air in the house is forced out duct 60A to vent 62. If the basement does not require dehumidification, then the system can be hooked up so that the stale air from the space 54 can be introduced to the second flow path at 20 to give up its heat before being exhausted at 22 and vent 62. Since this would recover more heat from the air in the house, the cost of water heating would be commensurately reduced.

Figure 5:
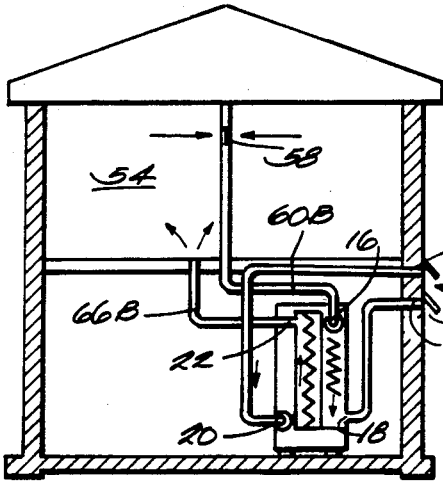
FIG. 5 is a schematic showing the manner in which the unit can be operated during the spring and fall months where air conditioning is not a factor.

In spring and fall air conditioning of outside air is not necessary. Therefore, the arrangement shown in FIG. 5 can be utilized with the flow through the evaporator coil as shown in FIG. 8. Thus, the stale air in the house is taken out of space 54 at 58 and goes through conduit 60B to inlet 16 and then exits at 18 to be exhausted from the house at vent 64. The outside air is drawn in at vent 62, enters at 20, exits at 22 and flows into space 54 through conduit 66B. Typically, this would result in the following conditions in the evaporator coil. Stale air from the house would enter at 16 at 70° and after passing to the outlet 18 would have its temperature reduced to 35°. Thus, the stale air gives up heat in the typical heat pump manner. Fresh air from outside comes in at a typical spring or fall day temperature of 50° and is dehumidified, then this air warmed up to 75° in flowing to outlet 22. If the supplemental heating coils 68, 70 are in operation, the air can be heated further to 110°.

With this arrangement and the changes in the ducting, the heat pump operation can be maximized for various times of the year. This arrangement will result in fresh air being provided to the interior in all seasons of the year and overcomes a serious problem with modern, extremely tight construction. The cost is very competitive with natural gas. The benefit of dehumidification of the basement during summer months is, in effect, free. In each of FIGS. 3, 4, 5, the ducting is shown without provision for transfer from one system to another. This would normally be incorporated, but to simplify the showing in the drawing, the transfer valve arrangements are omitted. That is well within the skill of any installer.

I claim:

1. A heat pump system comprising, a condenser coil, a compressor delivering hot compressed refrigerant to said condensor coil, an evaporator coil connected to receive refrigerant from said condenser coil, and means defining two separate counterflow air flow paths across said evaporator coil parallel to the temperature gradient in the coil, each flow path being in heat transfer relationship with said evaporator coil and having a warm end and a cool end, air being cooled in one of said paths and heated in the other path.

2. A heat pump system according to claim 1 in which said evaporator coil has multiple straight runs of coil tubing having at the end of each run a reverse bend leading to the next run, each of said air flow paths passing over approximately one-half of each said run.

3. A heat pump system according to claim 2 in which said runs of said evaporator coil lie in substantially the same plane.

4. A heat pump system according to claim 3 including a plurality of expansion control devices in said evaporator coil along the length of the coil tubing to progressively expand the refrigerant to progressively reduce the refrigerant temperature.

5. A heat pump system according to claim 4 in which said means defining two separate flow paths comprises, a central baffle extending through said evaporator coil and dividing each run generally in two, a side baffle near each end of each said run to thereby define first and second air ducts over said evaporator coil, one of said air flow paths originating at the warm end of said first air duct and the other of said air flow paths originating at the cool end of said second air duct.

6. A heat pump system according to claim 5 in which said evaporator coil includes an auxiliary coil having an auxiliary inlet and an outlet leading to the inlet to said evaporator coil, and including conduit means optionally delivering hot compressed partially condensed refrigerant from said condenser to said auxiliary inlet.

* * * * *